US006641426B2

(12) United States Patent
Saitoh

(10) Patent No.: US 6,641,426 B2
(45) Date of Patent: Nov. 4, 2003

(54) PRESS-CONTACTING TERMINAL FOR A FLAT CABLE

(75) Inventor: Yasushi Saitoh, Nagoya (JP)

(73) Assignees: Autonetworks Technologies, Ltd., Aichi (JP); Sumitomo Wiring Systems, Ltd., Mie (JP); Sumitomo Electric Industries, Ltd., Osaka (JP)

( * ) Notice: Subject to any disclaimer, the term of this patent is extended or adjusted under 35 U.S.C. 154(b) by 0 days.

(21) Appl. No.: 10/178,483

(22) Filed: Jun. 25, 2002

(65) Prior Publication Data

US 2002/0197904 A1 Dec. 26, 2002

(30) Foreign Application Priority Data

Jun. 25, 2001 (JP) ..... 2001-191054

(51) Int. Cl.[7] ..... H01R 4/26

(52) U.S. Cl. ..... 439/395; 439/396; 439/404; 439/422

(58) Field of Search ..... 439/395, 396, 439/400, 404, 422

(56) References Cited

U.S. PATENT DOCUMENTS

| | | | | | |
|---|---|---|---|---|---|
| 3,869,190 | A | * | 3/1975 | Bazille, Jr. | 439/400 |
| 4,062,615 | A | * | 12/1977 | Navarro | 439/400 |
| 4,472,014 | A | * | 9/1984 | Goodman et al. | 439/395 |
| 4,950,177 | A | * | 8/1990 | Szczesny | 439/404 |

FOREIGN PATENT DOCUMENTS

| | | | | |
|---|---|---|---|---|
| DE | 43 31 036 A1 | * | 3/1994 | 439/400 |
| JP | A 2002-124340 | | 4/2002 | |
| JP | A 2002-198114 | | 7/2002 | |

* cited by examiner

*Primary Examiner*—Tho D. Ta
(74) *Attorney, Agent, or Firm*—Oliff & Berridge, PLC.

(57) ABSTRACT

A press-contacting terminal for a flat cable includes a press-contacting portion having a pair of press-contacting blades opposed to each other with a slot formed therebetween. Blade portions for cutting a sheath of the flat cable in a direction of a width of the cable are formed respectively at inner and outer edges of each of the two press-contacting blades so that a centering operation can be positively effected when the misalignment of the center of the conductor relative to the press-contacting portion occurs.

4 Claims, 3 Drawing Sheets

PRESS-CONTACTING TERMINAL FOR A FLAT CABLE

BACKGROUND OF THE INVENTION

1. Field of the Invention

This invention relates to a press-contacting terminal for connecting conductors of a flat cable, used in an automotive wire harness or the like, to other conductors or an electronic/electrical equipment.

2. Description of the Related Art

As shown in FIGS. 6 and 7, a press-contacting terminal includes a plurality of press-contacting portions 3 each having a pair of press-contacting blades 1 and 1 opposed to each other with a slot 2 formed therebetween, and each of conductors 5 of a flat cable 4, together with a sheath 6 thereof, is grippingly inserted between the corresponding pair of press-contacting blades 1 and 1 (that is, inserted into the slot 2), and therefore is connected thereto.

More specifically, the slot 2 has a main portion 7 for being connected to the conductor 5 in a press-contacted manner, and an outwardly-spreading guide portion 8 for guiding the conductor 5 toward the main portion 5. Blade portions 9 and 9 are formed respectively at inner edges of distal end portions of the two press-contacting blades 1 and 1 exposed to the guide portion 8.

The blade portions 9 and 9 are formed by processing the inner edge portions of the distal end portions of the press-contacting blades into a tapering slanting surface-shape at the time when each press-contacting portion 3 is formed, for example, by blanking by the use of a pressing machine. The sheath 6 is cut by these blade portions 9 and 9, so that the conductor is exposed, and this exposed portion of the conductor is press-contacted with the press-contacting blades 1 and 1.

Here, in order to obtain the proper press-contacted condition, it is important that the center of each conductor 5 should be disposed accurately into line with the center of the corresponding press-contacting portion 3. Actually, however, the centers of the two are disposed out of line with each other within the range of their manufacturing tolerances.

In FIG. 6, A represents the pitch of the conductors 5, and B represents the pitch of the press-contacting portions 3. In this Figure, the relation, A>B, is established, and because of this pitch difference, the misalignment of the conductors 5 relative to the press-contacting portions 3 occurs (X represents the amount of this misalignment).

When this misalignment occurs, the conductor 5 engages one press-contacting blade 1, and is pressed in one direction, as shown in FIG. 7.

In this case, the conventional blade portions 9 and 9 are formed respectively at the inner edges of the press-contacting blades 1 and 1 of the press-contacting terminal as described above, and therefore the conductor 5 and the sheath 6 can move in the direction of the width of the cable only within the very narrow, flexibly-deformable range between the two blade portions 9 and 9, with the blade portions 9 and 9 biting into the sheath 6, and therefore the centering function of the guide portion 8 is much lowered.

As a result, the conductor 5 is deviated in one direction within the slot 2, or the conductor 5 is pressed hard against the blade portion 9 upon pushing of the conductor into the slot so that the conductor 5 is cut, which leads to a possibility that the connected condition is adversely affected. This phenomenon is conspicuous particularly when the press-contacting terminal is used at an intermediate portion of the flat cable where the degree of freedom of movement of the cable in the direction of the width of the cable is low, and it has been desired to improve this point.

SUMMARY OF THE INVENTION

It is therefore an object of this invention to provide a press-contacting terminal for a flat cable, in which the degree of freedom of movement of the flat cable in a direction of a width of the flat cable during a press-contacting operation is increased, thereby assisting in the centering of each conductor between a corresponding pair of press-contacting blades.

According to the present invention, there is provided a press-contacting terminal for a flat cable, comprising a press-contacting portion, wherein the press-contacting portion includes a pair of press-contacting blades opposed to each other with a slot formed therebetween, wherein a conductor of the flat cable is pushable into the slot so as to be connected to the pair of press-contacting blades in press-contacted relation thereto, and wherein the pair of press-contacting blades includes inner and outer blade portions for cutting a sheath during a press-contacting operation of the flat cable, the inner and outer blade portions are formed on inner and outer edges of each of the press-contacting blades respectively.

According to a second aspect of the present invention, the slot has a main portion for being connected to the conductor in a press-contacted manner, and an outwardly-spreading guide portion for guiding the conductor toward the main portion, the inner and outer blade portions are formed at the guide portion side distal end portion of each of the press-contacting blades.

According to a third aspect of the present invention, the distal end portion of each of the press-contacting blades is formed into triangular shape and has inner and outer slanting edges, the inner and outer blade portions are formed respectively on the inner and outer slanting edges.

According to a fourth aspect of the present invention, the following relation is established, $C \leqq D$, where C represents the length of the inner blade portion, and D represents the length of the outer blade portion.

In the above construction, the blade portions are formed respectively at the inner and outer edges of each of the two press-contacting blades, and therefore when misalignment occurs, the cable can easily move in a direction to absorb the misalignment (The degree of freedom of movement in the direction of the width of the cable is increased), since the outer blade portion can cut the sheath in the outward direction.

Therefore, the centering function between the two press-contacting blades is enhanced, and the conductor, disposed out of line with the press-contacting portion, can be smoothly moved into a center portion of the slot, thereby securing the proper press-contacted condition in which the deviation of the conductor, as well as the cutting of wire elements of the conductor, is eliminated.

In the construction of the second to fourth aspect, the inner and outer blade portions are formed only at the distal end portion of the press-contacting blade, exposed to the guide portion, that is, only at the region where the centering of the conductor by the guide portion can be effected. Therefore, in contrast with the case where these blade portions are excessively long, there are not encountered disadvantages that the wire elements of the conductor are cut by the inner blade portion after the connection and that the sheath is excessively cut by the outer blade portion.

In the construction of the third aspect, the blade portions are formed respectively at the two (inner and outer) edges of the triangular distal end portion of the press-contacting blade, and therefore the tip (apex portion) of each press-contacting blade bites into the sheath to cut this sheath in a dividing manner, and therefore the blade portions can easily penetrate into the sheath. In the construction of the fourth aspect, the outer blade portion is longer than the inner blade portion, and a centering-assisting operation by the outer blade portion is positively assured during the time when the centering is effected by the inner blade portion. Therefore, by adding the third and fourth aspect, the centering operation is effected positively and smoothly.

DETAILED DESCRIPTION OF THE PRESENT INVENTION

Preferred embodiments of the present invention will now be described with reference to FIGS. 1 to 5.

First Embodiment (see FIGS. 1 to 4)

Figure 1:
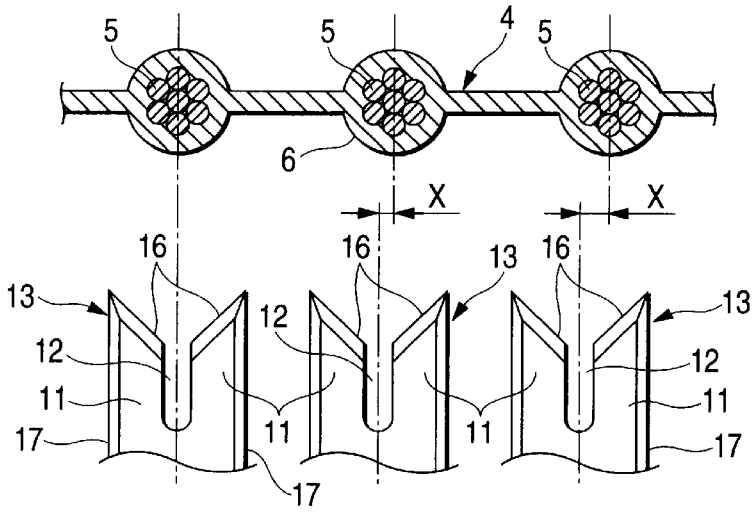
FIG. 1 is a view showing a first embodiment of a press-contacting terminal of the present invention and a flat cable.

As shown in FIG. 1, a press-contacting terminal includes a plurality of press-contacting portions 13 juxtaposed to each other at a predetermined pitch, each of the press-contacting portions 13 having a pair of press-contacting blades 11 and 11 opposed to each other with a slot 12 formed therebetween.

Figure 2:
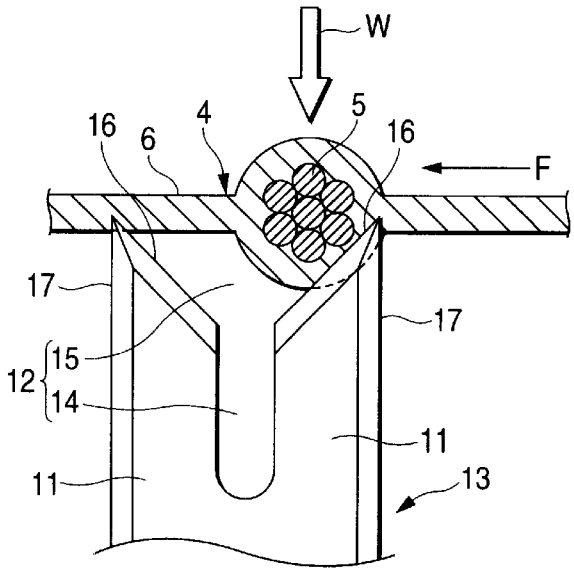
FIG. 2 is an enlarged view showing a press-contacting portion of the terminal.

As in the conventional press-contacting terminal, the slot 12 has a main portion 14 for being connected to a conductor 5 in a press-contacted manner, and an outwardly-spreading guide portion 15 for guiding the conductor 5 toward the main portion 14, as shown on an enlarged scale in FIG. 2. Inner blade portions 16 are formed respectively at inner edges (outwardly-spreading, slanting portions) of distal end portions of the two press-contacting blades 11 and 11 exposed to the guide portion 15.

Outer blade portions 17 are formed respectively at outer edges of the press-contacting blades 11 and 11, and extend over a substantially-entire length thereof, including the distal ends thereof. During a press-contacting operation, a sheath 6 of a flat cable 4 is cut by the inner and outer blade portions 16 and 17, and with this operation, the conductor 5 is exposed, and at the same time, misalignment is absorbed.

More specifically, when the conductor 5 is pushed into the slot 12 in a direction of a thick arrow (FIG. 2), with the center of the conductor 5 disposed out of line with the center of the press-contacting portion 13 (X represents the amount of this misalignment, and W represents this pushing force), an external force (correcting force) F, exerted in a direction (indicated by a thin arrow) to eliminate the misalignment, acts on the conductor 5 and the sheath 6 through the guiding operation of the guide portion 15.

Figure 6:
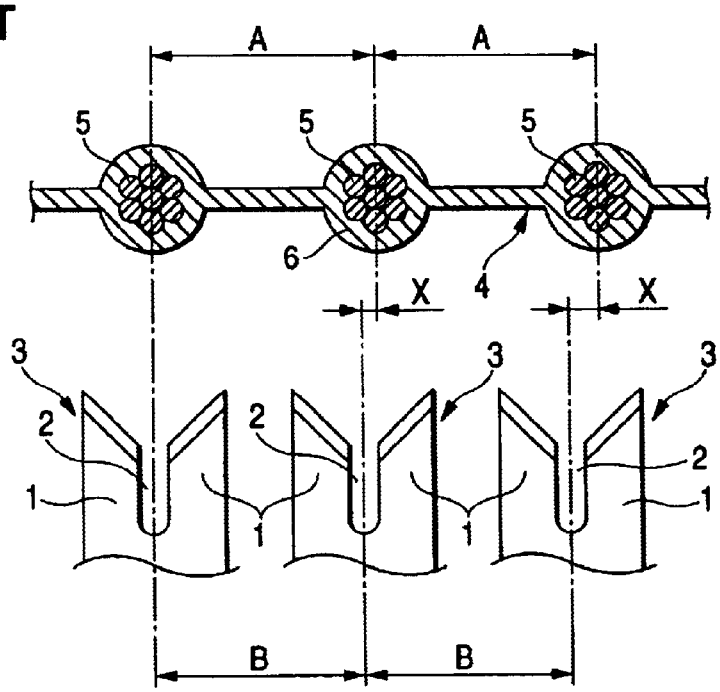
FIG. 6 PRIOR ART
FIG. 6 is a view showing a conventional press-contacting terminal and a flat cable.
Figure 7:
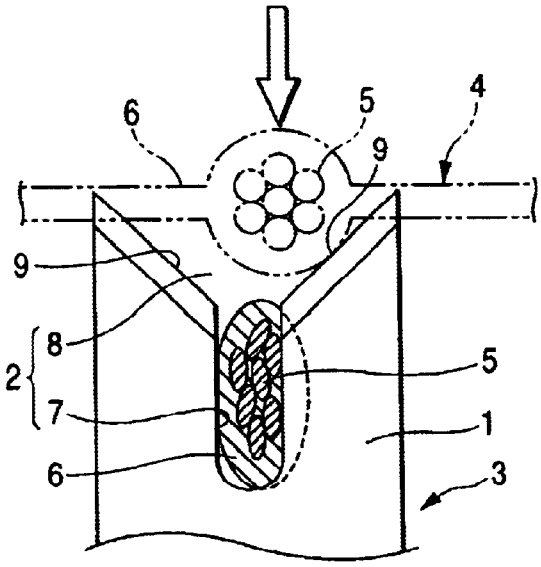
FIG. 7 PRIOR ART
FIG. 7 is a view showing a condition in which a flat cable is press-contacted to the terminal by pushing the flat cable.

In such a case, in the conventional press-contacting terminal of FIGS. 6 and 7, the movement of the sheath 6 is prevented by the reverse sides (having no blade) of the blade portions 9, and therefore the correcting force F is canceled.

On the other hand, in the press-contacting terminal of this embodiment, the blade portions 16 and 17 are formed respectively at the inner and outer edges of each of the two press-contacting blades 11, and therefore when this correcting force F is applied, the sheath 6 is cut by the outer blade portions 17 in a direction (right-hand direction in the drawings) opposite to the direction of application of this correcting force F, and as a result the conductor 5 and the sheath 6 are freely moved in the direction to eliminate the misalignment.

Figure 3:
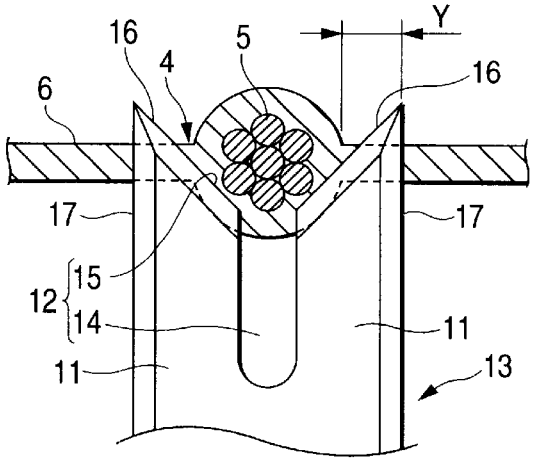
FIG. 3 is a view showing a process of press-contacting the flat cable to the press-contacting portion by pushing the flat cable.
Figure 4:
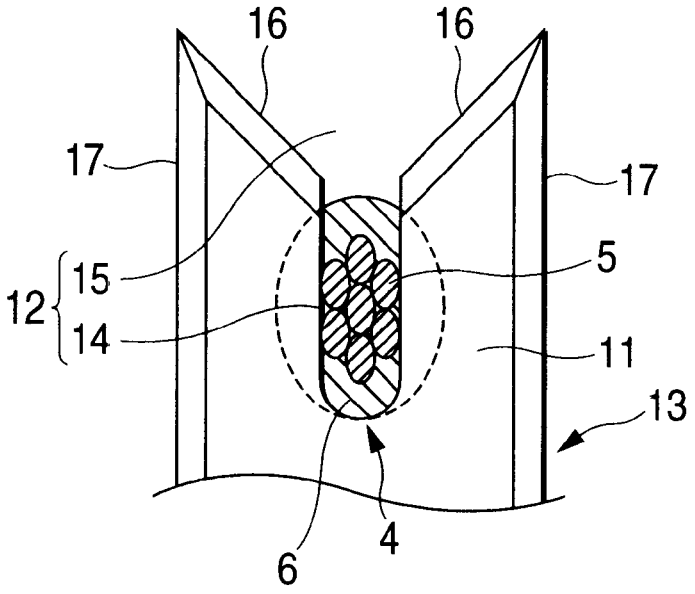
FIG. 4 is a view showing a condition in which the press-contacting operation is completed.

Namely, the degree of freedom of movement of the conductor 5 and the sheath 6 is increased, and the centering operation is positively effected. Therefore, the conductor 5 is moved by an amount Y almost equal to the misalignment amount X as shown in FIGS. 3 and 4, and is located at a center portion of the slot 12, and therefore is connected in a press-contacted manner to the two press-contacting blades 11 and 11 in the proper condition.

The inner and outer blade portions 16 and 17 may be formed into a tapering surface-shape when forming each press-contacting portion 13 by blanking, for example, by the use of a pressing machine as described above for the conventional blade portions 9, or the blade portions 16 and 17 may be formed by cutting.

Figure 5:
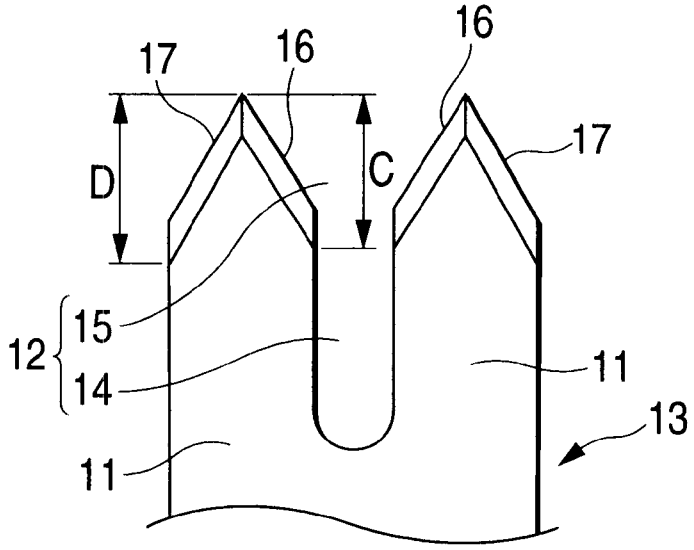
FIG. 5 is a view showing a second embodiment of a press-contacting terminal of the invention.

Second Embodiment (see FIG. 5)

Here, only the difference from the first embodiment will be described.

In a second embodiment, a distal end portion of each of two press-contacting blades 11 and 11, exposed to a guide portion 15 of a slot 12, is formed into a tapering, triangular shape, and has two (inner and outer) slanting edges, and inner and outer blade portions 16 and 17 are formed respectively at the two slanting edges of the triangular distal end portion.

With this construction, the tip (apex portion) of each press-contacting blade 11 bites into the sheath 6 to cut this sheath right and left in a dividing manner, and therefore the two press-contacting blades 11 and 11 can easily penetrate into the sheath 6, and therefore can easily cut the sheath.

Here, the relation, $C \leqq D$, is established, where C represents the length of the inner blade portion 16, and D represents the length of the outer blade portion 17.

With this construction, the outer blade portion 17 is longer than the inner blade portion 16, and the above-mentioned centering-assisting operation by the outer blade portion 17 is assured during the time when the centering is effected by the inner blade portion 16.

Thanks to the above two effects, the centering operation is effected more positively and smoothly.

In the first embodiment, the outer blade portion 17 may not be formed over the substantially-entire length of the press-contacting blade 11, but may be formed only at the distal end portion of the press-contacting blade as in the second embodiment. In this case, preferably, the outer blade portion 17 is a little longer than the inner blade portion 16 as described above for the second embodiment.

As described above, in the present invention, the blade portions are formed respectively at the inner and outer edges of each of the two press-contacting blades, and therefore when the misalignment of the center of the cable conductor relative to the press-contacting blades occurs, the outer blade portion cuts the sheath in the outward direction so as to enhance the centering function, thereby moving the deviated conductor into the center portion of the slot, so that there can be secured the proper press-contacted condition in which the deviation, as well as the cutting of the wire elements of the conductor, is eliminated.

What is claimed is:

1. A press-contacting terminal for a flat cable, comprising a press-contacting portion, wherein the press-contacting portion includes a pair of press-contacting blades opposed to each other and arranged in a direction perpendicular to a longitudinal direction of the flat cable with a slot formed therebetween, wherein a conductor of the flat cable is pushable into the slot so as to be connected to the pair of press-contacting blades in press-contacted relation thereto, and wherein the pair of press-contacting blades includes inner and outer blade portions for cutting a sheath during a press-contacting operation of the flat cable, the inner and outer blade portions being formed on inner and outer edges of each of the press-contacting blades respectively, the inner blade portion cutting toward the conductor and the outer blade portion cutting away from the conductor.

2. The press-contacting terminal as claimed in claim 1, wherein the slot has a main portion for being connected to the conductor in a press-contacted manner, and an outwardly-spreading guide portion for guiding the conductor toward the main portion, the inner and outer blade portions being formed at the guide portion side distal end portion of each of the press-contacting blades.

3. The press-contacting terminal as claimed in claim 2, wherein the distal end portion of each of the press-contacting blades is formed into triangular shape and has inner and outer slanting edges, the inner and outer blade portions being formed respectively on the inner and outer slanting edges.

4. The press-contacting terminal as claimed in claim 3, wherein the following relation is established, $$C \leq D,$$

where C represents the length of the inner blade portion, and D represents the length of the outer blade portion.

* * * * *